US005785301A

United States Patent [19]

Scheindel

[11] Patent Number: 5,785,301

[45] Date of Patent: Jul. 28, 1998

[54] TILT OPENING VALVE ASSEMBLY

[76] Inventor: Christian T. Scheindel, HCR 67 Box 45, Randolph Center, Vt. 05061

[21] Appl. No.: 637,940

[22] Filed: Apr. 23, 1996

[51] Int. Cl.[6] ..... B65D 83/14

[52] U.S. Cl. ..... 251/354; 222/402.22

[58] Field of Search ..... 251/349, 354; 222/402.22

[56] References Cited

U.S. PATENT DOCUMENTS

| | | | |
|---|---|---|---|
| 2,704,622 | 3/1955 | Soffer . | |
| 2,829,806 | 4/1958 | Tedaldi . | |
| 2,914,224 | 11/1959 | Michel . | |
| 2,954,903 | 10/1960 | Collins . | |
| 2,957,610 | 10/1960 | Michel . | |
| 2,965,270 | 12/1960 | Soffer et al. . | |
| 2,975,944 | 3/1961 | Michel . | |
| 3,048,307 | 8/1962 | Michel . | |
| 3,132,774 | 5/1964 | Soffer . | |
| 3,482,737 | 12/1969 | Marder et al. . | |
| 4,171,074 | 10/1979 | Diamond | 251/349 |
| 4,805,813 | 2/1989 | Metcoff et al. . | |
| 4,824,075 | 4/1989 | Holzboog . | |
| 5,441,181 | 8/1995 | Scheindel . | |

FOREIGN PATENT DOCUMENTS

| | | | |
|---|---|---|---|
| 1012500 | 7/1957 | Germany | 251/354 |
| 848110 | 10/1960 | United Kingdom | 251/354 |

*Primary Examiner*—A. Michael Chambers
*Attorney, Agent, or Firm*—McAulay Fisher Nissen Goldberg & Kiel, LLP

[57] ABSTRACT

A tilt action valve assembly is disclosed which has a cup for mounting to a container, the cup holding a grommet seal which surrounds a valve stem. The grommet seal has a lower portion which surrounds a lower portion of the stem and which provides a seal for engagement with a valve stem seat. An upper portion of the grommet seal is bowed and thin walled to absorb stem displacement above the cup, thus limiting seal displacement below the cup. A lip locks the upper portion to the stem to assure co-movement therewith. Utilizing the valve assembly provides for a maximized opening between the stem seat and seal to optimize the flow of fluid through the stem.

4 Claims, 2 Drawing Sheets

TILT OPENING VALVE ASSEMBLY

TECHNICAL FIELD

This invention relates to dispenser valves for pressurized containers and more particularly to tilt opening dispenser valve assemblies.

BACKGROUND OF THE INVENTION

Tilt action valves for pressurized containers have been used to dispense products such as shaving cream, cheese products and whipped cream. Various valve assemblies are described for example in U.S. Pat. Nos. 4,805,813, 2,965,270, 2,957,610, 2,914,224 and 2,828,806.

Referring to FIG. 1*a*, a prior art tilt action valve assembly A is shown. The assembly includes a cup B for mounting the assembly to a collar on top of a container and a grommet C made of a resilient material such as rubber, which resides within and surrounds a hole in the cup. The grommet C contains an axial opening D surrounding a valve stem E to prevent leakage around the outside of the stem. The grommet acts as a seal between the cup and the valve stem, both prior to and during valve activation.

The valve stem has a discharge nozzle F at one end and a sealing seat G at the other end. Adjacent to the sealing seat are a plurality of flow orifices H. When not in use, the seat rests in contact with a lower portion C' of the grommet seal.

To operate the valve assembly, the stem is tilted to displace the seat from the lower portion of the grommet, which exposes the orifices to a pressurized fluid within the container. The fluid enters the orifices and exits through the discharge nozzle.

One problem with the present valve assembly is that when the stem is tilted, for example, to the right, the resilient seal on the right is displaced downwardly, while the stem on the left side compresses the resilient material upwardly. In essence, the seal is displaced in the same fashion as the valve stem but to a lesser degree. This occurs because the stem pivots about point I, adjacent the hole in the cup. This following action has the effect of reducing the size of the opening between the seal and the seat, restricting the flow of fluids through the discharge nozzle. This narrowed opening is a particular disadvantage in cans dispensing viscous fluids, where a restricted opening can inhibit the flow entirely. With this displacement, leakage is possible at points J and K.

Another problem, shown in FIG. 1*b*, is that when the container is pressured, the seat G compresses the grommet lower portion C' which causes a gap L between the grommet upper portion C" and an upper shoulder M. This opening provides the opportunity for leakage around the stem E when the container is filled.

SUMMARY OF THE INVENTION

It is an object of the present invention to provide a tilt action valve assembly which provides an optimum displacement of the valve stem seat relative to the resilient seal to promote discharge of viscous fluids.

It is a further object to provide a tilt action valve assembly which uses a combination of expansion and compression of the grommet seal to accommodate a combination of downward and tilt action, to maximize fluid flow.

It is a further object to provide a tilt action valve assembly which resists leakage at both the cup to grommet and nozzle to grommet interfaces.

These and other objects of the present invention are achieved by a tilt action valve assembly for a pressurized container comprising a tubular valve stem, a resilient grommet surrounding a portion of the valve stem and having an end in contact with a seat of the stem for sealing engagement therewith, a cup surrounding the grommet for mounting the assembly in the container an upper portion of the grommet seal being radially enlarged in its inner diameter and having a reduced wall thickness, and, an upper inwardly projecting lip engaged in a corresponding circumferential groove in the valve stem for co-movement therewith.

By providing a radially enlarged, the weakened area, any tilt of the stem affecting the grommet above the cup is not translated to the lower seal portion, preventing upward displacement of the seal material. In essence, the weakened area outwardly bows to accommodate the downward stem movement, to avoid displacement of the lower portion of the grommet seal in the direction of travel of the stem seat with the lip to groove seal at the upper portion of the grommet preventing leakage by sealing to the stem as the stem and grommet move together. The stem then moves downwardly from the contact point such that the opposite end of the seat travels in a downward direction away from the seal, maximizing the opening by avoiding the "follower" effect.

BRIEF DESCRIPTIONS OF THE DRAWINGS

FIG. 1*a* is a cross-sectional view of a prior art tilt action valve assembly; FIG. 1*b* is a cross-sectional view of the prior art valve assembly with the stem in the upright position.

DETAILED DESCRIPTION OF THE INVENTION

Figure 1A:
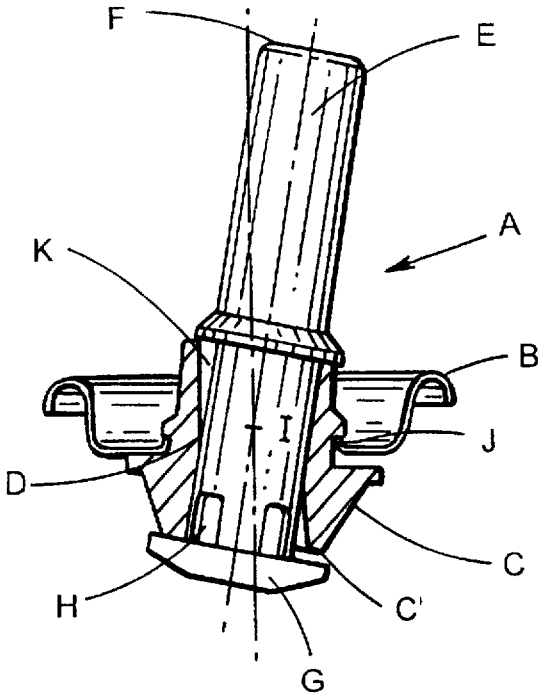
FIG. 1a PRIOR ART
Figure 1B:
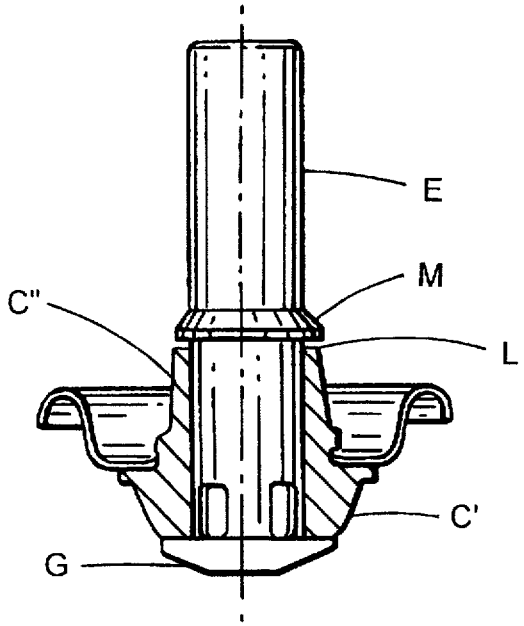
FIG. 1b PRIOR ART
Figure 2:
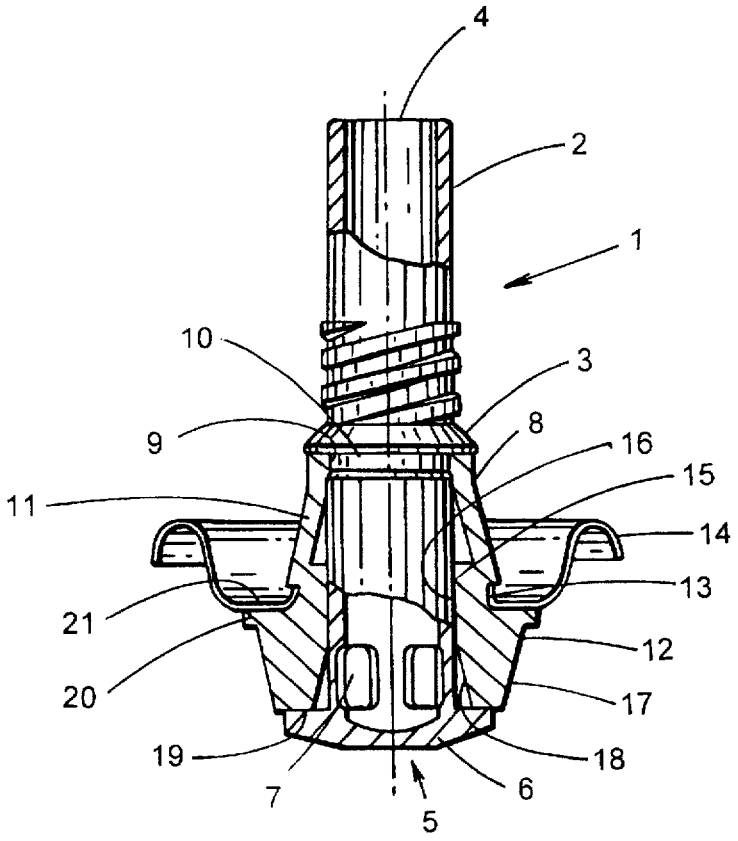
FIG. 2 is a cross-sectional view of a tilt action valve assembly in accordance with the present invention.

Referring to FIG. 2, a tilt action valve assembly 1 has a stem 2, with an upper shoulder 3, discharge nozzle 4 and an entrance end 5. The entrance end has a seat 6 adjacent to a plurality of flow orifices 7.

A resilient grommet 8 is in sealing engagement with the stem 2. The grommet has a locking lip 9 which resides in a groove 10 in the stem 2, below the upper shoulder 3. An upper portion 11 of the grommet has a larger diameter than the locking lip 9 and a relatively thin wall thickness to provide a weakened area for collapse in a bow like fashion when subject to compression, while also allowing for expansion when in tension. This resilience is necessary to prevent the lip from disengaging from the groove. Sufficient resiliency must be provided in the enlarged area to assure co-movement of the lip with the stem.

The grommet has a cup seal 12 below the upper portion 11, having a shape to accommodate a sealing lip 13 of a mounting cup 14. An inner wall 15 of the upper portion surrounds a portion 16 of the stem, with a slight interference fit to allow slidable but sealing engagement with the stem. The wall 15 is adjacent to the cup seal such that when the stem and grommet are placed within the cup, there is some compression of the stem sealing material to limit leakage.

A lower portion 17 of the grommets seal includes a tapered surface 18 to accommodate tilt, disposed adjacent to the portion of the stem containing the flow orifices. A bottom surface 19 of the lower portion acts as a stem seal which is in sealing engagement with the stem seat 6, prior to valve actuation. The grommet further includes a stop 20 disposed below the mounting cup to engage a bottom surface 21 of the cup to lock the grommet in position and also to provide some additional area for sealing against the cup to prevent leakage.

Figure 3:
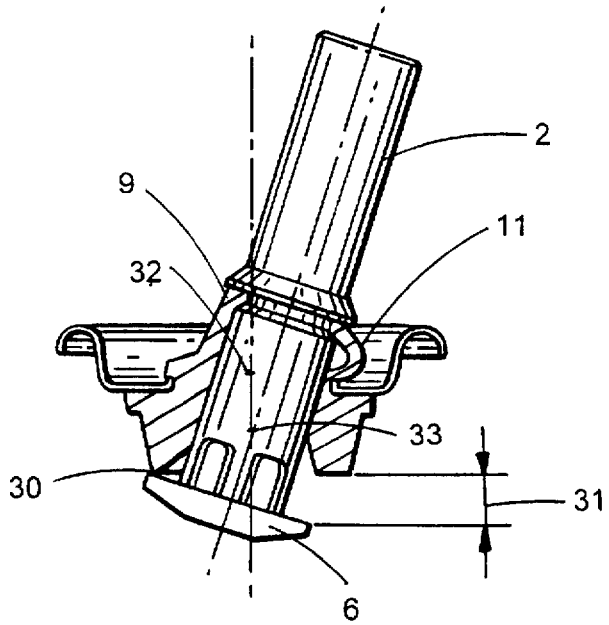
FIG. 3 is a cross-sectional view of the valve assembly of FIG. 3, shown in the tilted condition.

Referring to FIG. 3, the valve assembly in accordance with the description in FIG. 2 is shown in the tilted condition. The stem 2 is tilted to the right, compressing the upper portion 11 of the grommet seal in the direction of stem travel, such that it bows outwardly. At the same time, the locking lip 9, engaged to the stem, pulls upwardly the upper portion the upper portion on the left side of the stem, flattening the upper portion to the stem sidewall. When tilted, the valve stem seat 6 engages the grommet seal at the point 30, which due to the enlarged weaken upper portion, holds the seat and acts as a pivot as the stem is rotated in the direction of tilt. By holding the seat, near immediate separation occurs between the seat and seal on the left side to initiate flow, as the bowing of the grommet seal above the cup absorbs the grommet compressive force such that the seal beneath the cup is not displaced downwardly. Thus a maximized opening 31 between the seal and the seat occurs.

Since the weakened upper portion restrains displacement of the lower seal portion, sealing contact with the cup is more positively retained and leakage is avoided. In addition, the weakened upper portion of the valve assembly allows operation of the valve by downward displacement as well as through tilt action. Instead of pivoting about point 32, the stem when tilted has its center at 33. Consequently, an angled discharge stem may be used to allow pressing down on the stem to cause actuation in accordance with the present invention. The prior art valves, with axially rigid grommet seals, could not be displaced downwardly.

Typically, it is important to maintain the sealing engagement between the stem and seal, prior to and during pressurization to avoid gas bypass or product leakage which in essence renders the container unusable. It is thus critical for the seal to be maintained when pressurization is initiated.

By providing an upper lip/groove seal, there is a positive assurance, when the stem is inserted into the grommet that a seal has been achieved prior to pressurization. This avoids the gap between the upper grommet seal and the upper shoulder which occurs in the prior art valve assembly.

Stems usable with the invention are typically composed of plastic materials such as polypropylene, an acetyl copolymer known as celcon or acrylonitrile butadiene styrene (ABS) among others. Further, the mounting cup is typically made of steel or another metal which can be readily crimped onto a metal container. The grommet seal is typically composed of a resilient elastomer materials such as natural or synthetic rubber, silicone elastomer, teflon, fluorinated ethylene propylene (PEP), etc. although other materials may be used without varying from the scope of the invention. Of course, compatibility with the product to be dispensed and propellant are a consideration in the choice of materials, and it is well within the skill of one in this art to select materials appropriate for incorporation in the inventive tilt action valve assembly.

While preferred embodiments of the present invention have been shown and described, it will be understood by those skilled in the art that various changes or modifications could be made without varying from the scope of the present invention.

I claim:

1. A tilt action valve assembly for a pressurized container comprising a tubular valve assembly, a resilient grommet surrounding a portion of the valve stem and having a lower seal portion in contact with a seat of the stem for sealing engagement therewith, the grommet having a cup seal surface, a cup surrounding the grommet for mounting the assembly in the container, an upper resilient portion of the grommet seal above the cup seal surface having a relatively thin wall thickness to provide a weakened area for collapse in a bow-like fashion when subject to compression an upper inwardly projecting circumferential lip disposed above the upper resilient portion engaged in a corresponding groove in the valve stem for co-movement therewith, the upper portion having a larger diameter than the lip and being resilient to bow in compression and expand in tension to limit displacement of the lower seal portion during movement of the valve stem.

2. The valve assembly of claim 1 wherein the grommet has an upper locking lip mateable with a groove in the valve stem to provide for integral movement of both during stem displacement.

3. The valve assembly of claim 1 wherein the grommet has the cup seal surface having a shape to accept a sealing lip of the mounting cup, the grommet further having a stop which can be placed in contact with the cup, to prevent leakage thereby.

4. The valve assembly of claim 1 wherein a lower portion of the grommet seal has a tapered surface to accommodate tilt.

* * * * *

UNITED STATES PATENT AND TRADEMARK OFFICE

CERTIFICATE OF CORRECTION

PATENT NO. : 5,785,301

DATED : July 28, 1998

INVENTOR(S) : Christian T. Scheindel

It is certified that error appears in the above-identified patent and that said Letters Patent is hereby corrected as shown below:

Column 3, line 18, the term "left side" should read -- right side --.

Signed and Sealed this

Seventeenth Day of October, 2000

*Attest:*

Q. TODD DICKINSON

*Attesting Officer*

*Director of Patents and Trademarks*